US006587653B2

(12) United States Patent
Luxem

(10) Patent No.: US 6,587,653 B2
(45) Date of Patent: Jul. 1, 2003

(54) APPLYING AND MEASURING TONER IN A PRINT ON A SUBSTRATE BY A PRINTING MACHINE

(75) Inventor: Wolfgang Luxem, Kiel (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/929,723

(22) Filed: Aug. 14, 2001

(65) Prior Publication Data

US 2002/0044785 A1 Apr. 18, 2002

(51) Int. Cl.[7] ..... G03G 15/00
(52) U.S. Cl. ..... 399/49; 399/15; 399/60
(58) Field of Search ..... 399/49, 72, 73, 399/15, 27, 60; 347/19, 55; 358/504, 406, 296

(56) References Cited

U.S. PATENT DOCUMENTS 5,175,585 A 12/1992 Matsubayashi et al. ..... 399/49
5,250,988 A 10/1993 Matsuura et al. ..... 399/42
5,307,119 A 4/1994 Folkins et al. ..... 399/46
5,576,811 A * 11/1996 Kobayashi et al. ..... 399/15
6,018,635 A 1/2000 Edura ..... 399/43

FOREIGN PATENT DOCUMENTS

DE 195 09 852 A1 9/1995
EP 0 452 818 A2 10/1991

OTHER PUBLICATIONS

JP 04251055 A (Sep. 7, 1992), In: Patent Abstracts of Japan.

* cited by examiner

*Primary Examiner*—Sophia S. Chen
(74) *Attorney, Agent, or Firm*—Lawrence P. Kessler

(57) ABSTRACT

Applying a toner print to a substrate, in particular to a substrate (3). At least one print (7) is applied to the substrate. Then, the amount of toner applied to the substrate is measured by a measuring device (21). Finally, the difference between the actual amount of toner and a desired amount of toner in the print (7) applied to the substrate is determined, the printing process being influenced on the basis of the deviation in such a way that the difference in the amounts of toner is reduced or at least remains the same during subsequent prints.

10 Claims, 2 Drawing Sheets

APPLYING AND MEASURING TONER IN A PRINT ON A SUBSTRATE BY A PRINTING MACHINE

FIELD OF THE INVENTION

The invention relates to applying a toner print to a substrate, and measuring the amount of toner applied to the substrate by a printing machine.

BACKGROUND OF THE INVENTION

In order to achieve a constant image quality in printing machines, it is necessary to control the printing process in such a way that the amount of toner in each case applied in the individual image areas results in the desired density and remains constant or substantially constant during continuous printing. In known printing machines, in the unfixed state of the toner, when the latter, for example, is still on an image carrier, such as an image cylinder, the toner density is measured and the printing process is controlled with the aid of this value. In the event of high densities of the toner, the relationship between the measured toner density and the amount of toner transferred to the substrate is no longer linear. As a result, in particular at high toner densities, which result from a high amount of toner applied to individual image areas, precise control of the printing process is not possible in every case.

In known printing machines, in the unfixed state of the toner, when the latter, for example, is still on an image carrier, such as an image cylinder, the toner density is measured and the printing process is controlled with the aid of this value. In the event of high densities of the toner, the relationship between the measured toner density and the amount of toner transferred to the printable surface is no longer linear. As a result, in particular at high toner densities which result from a high amount of toner applied to individual image areas, precise control of the printing process is not possible in every case.

SUMMARY OF THE INVENTION

It is therefore an object of the invention to provide that precise control or regulation of the amount of toner transferred to a substrate by a printing machine is ensured. In order to achieve the object, at least one print is applied to the substrate, for example paper, board, plastic or the like. Then, with the aid of a measuring device, the amount of toner transferred to the substrate is measured and the deviation between the actual amount of toner (ACT) applied in the area of the print and a desired amount of toner (DES) is determined. The difference between the actual amount of toner and the desired amount of toner is used to influence the printing process, the influence being exerted in such a way that the amount of toner transferred to the substrate to form the print is reduced or increased as a function of the respective deviation, so that the difference between the ACT amount of toner and the DES amount of toner becomes smaller. If the difference between the ACT amount of toner and the DES amount of toner is within a specific tolerance band, reducing or increasing the amount of toner applied to the substrate, and therefore exerting an influence on the control of the printing machine, is not required, so that the difference remains the same. The direct measurement of the amount of toner transferred to the substrate permits very precise control of the printing process, even if the print exhibits high toner densities. In order to optimize the printing process and to increase the measuring sensitivity further, provision is made to measure the toner coverage in advance; that is to say, the amount of toner transferred to the substrate at a specific setting of the printing process or of the printing machine. At least one test image is applied to a transport surface of a transport device for the substrate. Here, the term transport surface usually designates a part of a transport belt belonging to the transport device. As a result of applying the test image to the transport surface, the measurement step is independent of the condition of the substrate, for example moisture or thickness fluctuations. In addition, wastage of the substrate in the event of the wrong amounts of toner is avoided, since the printing of the substrate only begins when the difference between the ACT amount of toner and the DES amount of toner is within a specific tolerance band, that is to say has been controlled out to the desired extent.

In order to achieve the object, a printing machine is proposed, which includes a measuring device with the aid of which the amount of toner applied to the printable surface can be determined. By using the measuring device, exact determination of the amount of toner applied within an individual image area or within a print can be determined. This permits accurate control of the printing process, the measuring device being such that the respective amount of toner in a print can be determined accurately, both in the case of low and in the case of high toner densities.

The shape and/or size of at least one test image is advantageously matched to at least one electrode of a first capacitive sensor. Since the toners for different colors can have a different relative dielectric constant $\epsilon$, at least one test image is preferably printed for each color and, for different amounts of toner, the characteristic curve "amount of toner per unit area in relation to the sensor output signal" from the sensor is determined. For mixed colors, the characteristic curve of the sensor can likewise be determined. In a preferred embodiment, the measuring device has at least a first capacitive sensor which, for example, is designed as a proximity switch or distance measuring device. The construction and function of the capacitive sensor are known in the literature (for example from "Induktive und kapazitive Sensoren" (Inductive and capacitive sensors) by Andreas Schiff, Verlag Moderne Industrie (1989) and "Sensortechnik" (Sensor engineering) by Harry Herold, Huthig Verlag Heidelberg (1993)), of which the content relating to the construction and the function of the capacitive sensor is made the subject of this application. In the case of these devices, which include a proximity switch or a distance measuring device, for example, the change in capacitance of a capacitor is measured. Given a constant electrode area, the capacitance may be changed by enlarging the distance between the two electrodes of the capacitor or by changing the effective relative dielectric constant e of the medium between the electrodes. In a particularly preferred embodiment, the two capacitor plates are formed by the first capacitive sensor and the measured object, in particular the substrate with toner applied.

In an advantageous exemplary embodiment, provision is made for the first capacitive sensor to be arranged in a fixed position at a distance from and opposite a transport surface of a transport device for the substrate. On the basis of this arrangement, the substrate and the toner applied thereto, as they move through the interspace between the sensor and the transport surface on which the substrate rests, in each case effect a change in the relative dielectric constant $\epsilon$ of the medium between the capacitor plates (sensor and substrate). This change effects a corresponding change in the sensor output signal and can be used to control the printing process. With the aid of the control system, the amount of toner in each case applied to the substrate is increased or, if appropriate, reduced.

In order to carry out the measurement of the amount of toner on the substrate, provision is made in a first exemplary embodiment for the toner to be fixed on the substrate previously by, for example, being melted on in a known way. In another embodiment, the measurement of the amount of toner is carried out with the toner transferred to the substrate but in the unfixed state.

The aforementioned "measured object" is initially the transport surface, which for example, is formed by a transport belt. As soon as the print with a substrate having a specific amount of toner passes into the interspace between the sensor and the transport surface, the "measured object" is formed by the substrate. It remains to be recorded that, with the aid of the first capacitive sensor, the distance between the sensor arranged in a fixed position and the substrate is measured. The amount of toner applied to the substrate results in a specific toner density for the print having a constant area, the distance between the sensor and the substrate becoming smaller as the toner density increases. In other words, the greater the amount of toner applied to an individual printing area, the higher the amount of toner projects beyond the surface of the substrate, and the lower is the distance, measured with the aid of the capacitive sensor, between the sensor and the substrate or the print.

In a preferred embodiment, the first capacitive sensor is triggered in such a way that it measures the distance between itself and the measured object (transport surface or substrate) at the time at which the test image is located precisely under it or in the interspace bounded by the sensor and the transport surface. In order to control the first capacitive sensor, signals from the existing control devices belonging to the printing machine, for example, can be used, which simplifies their construction.

The invention, and its objects and advantages, will become more apparent in the detailed description of the preferred embodiment presented below.

BRIEF DESCRIPTION OF DRAWINGS

The invention will be explained in more detail below using the drawings, in which.

DETAILED DESCRIPTION OF THE INVENTION

Figure 1:
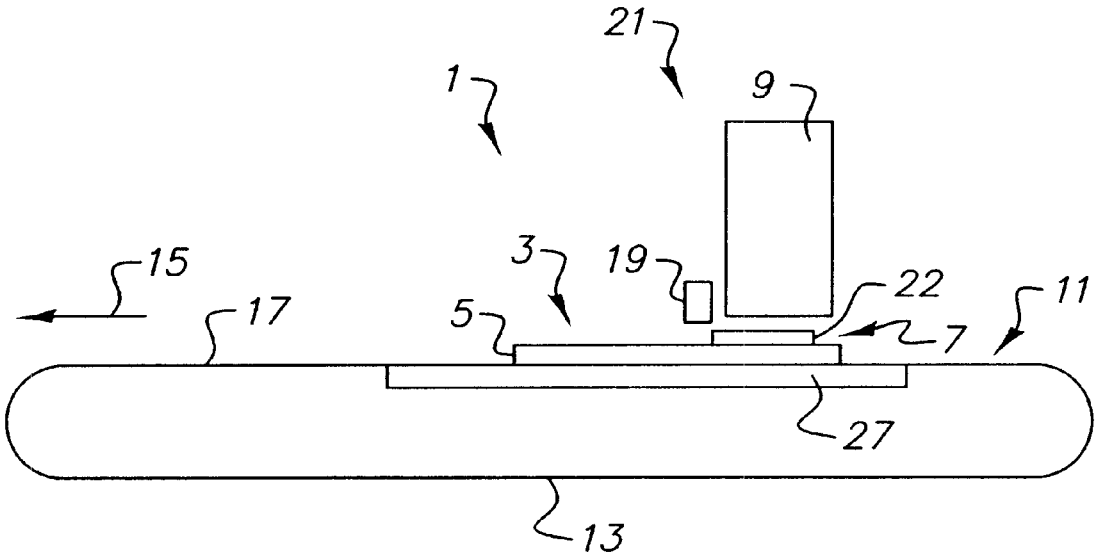
FIG. 1 shows a detail from a printing machine in the area of a printing unit in a schematic illustration.

FIG. 1 shows a detail of an exemplary embodiment of a printing machine 1, for example an electrophotographic printing machine, which can be employed generally for applying liquid or powdered toner to a substrate 3, which is formed here, purely as an example, by a paper sheet 5. The construction and function of the printing machine are fundamentally known, for example from U.S. Pat. No. 5,812,170 or U.S. Pat. No. 6,031,552, so they will not be specifically discussed here.

The printing machine 1 has a plurality of printing units, with the aid of which in each case one print 7 in at least one specific color, for example black, yellow, magenta, cyan or a mixed color, is transferred to the substrate 3 in a known way. Of the printing units, only the printing unit 9 is illustrated schematically in FIG. 1.

Arranged underneath the printing unit 9 (arranged in a stationary position) is a transport device 11 which, in the exemplary embodiment illustrated in FIG. 1, has an endless transport belt 13 which can be displaced horizontally in the machine running direction 15 (arrow) with the aid of a drive device (not illustrated). The guidance of the transport belt 13 is chosen in such a way that, in the area of the printing unit 9 and in the areas upstream and downstream of the printing unit 9, it is guided at a predetermined distance from the latter.

The transport belt 13 has a transport surface 17 on which the substrate 3 to be printed with the aid of the printing unit 9 are deposited one behind the other in the machine running direction 15 and/or one beside the other over the width of the printing machine 1 and, by displacement of the transport belt 13 are guided underneath the printing unit 9. With the aid of the printing unit 9, a specific, adjustable amount of toner in the form of the print 7 is transferred to the substrate 3, which results in a specific toner density being established in the print 7.

Figure 3:
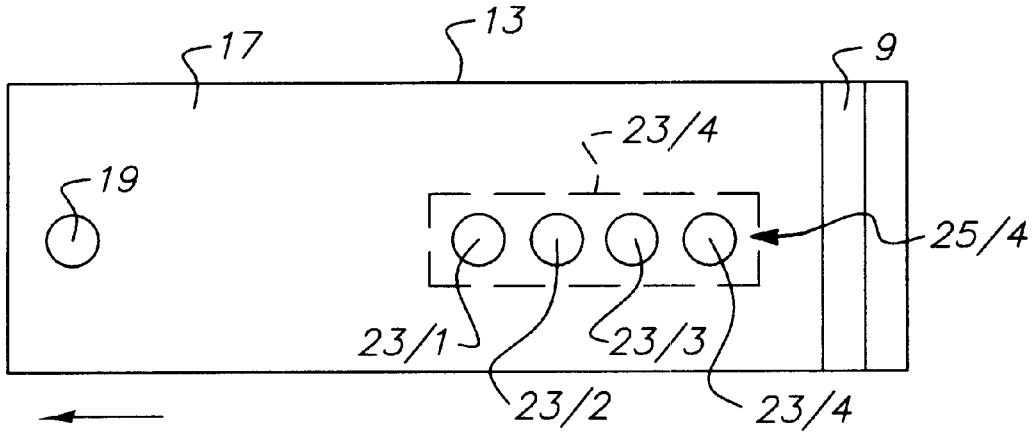
FIG. 3 shows a plan view similar to that of FIG. 2, the test images being applied to the transport surface.

Arranged downstream of the printing unit 9 in the machine running direction 15 is a first capacitive sensor 19/1 to 19/3, which, as part of a measuring device 21 which is not specifically illustrated, is used to determine the amount of toner applied to the substrate 3. The first capacitive sensor 19/1 to 19/3 is arranged at a fixed distance with respect to the transport surface 17 of the transport belt 13. The capacitive sensor 19/1 to 19/3 is a proximity switch or a distance measuring device, whose functional principle is based on the fact that the capacitance change of a capacitor is measured. The two capacitor plates are formed here by the first capacitive sensor 19/1 to 19/3 and the measured object. Depending on the position of the substrate 3, the measured object is either the unprinted or printed transport surface 17 of the transport belt 13, as illustrated in FIG. 3, the substrate 3 in an unprinted area, as illustrated in FIG. 1, or the substrate 3 in the area of the print 7. Given a constant electrode area, the capacitance of the capacitor may be changed by enlarging the distance between the two electrodes, that is to say between the first sensor 19/1 to 19/3 and the measured object, or by changing the effective relative dielectric constant $\epsilon$ of the medium between the electrodes. As a result, it is possible to determine the amount of toner actually applied to the substrate (ACT) for the print 7 of a specific area. The greater the amount of toner, the smaller is the distance between the print 7 and the first sensor 19/1 to 19/3, so that the measurement of the distance between the surface 22 of the print 7 and the first sensor 19/1 to 19/3 enables precise determination of the amount of toner and therefore also of the toner density of the print 7. Using a control device (not illustrated), for example the control device of the electrophotographic printing machine 1, the size of the difference between the actual amount of toner transferred to the substrate 3 and a desired, adjustable amount of toner (DES), which ensures a specific toner density of the print 7, is then determined. Depending on the difference, the control of the electrophotographic process is changed in such a way that the deviation between the measured ACT amount of toner and the amount of toner becomes smaller or, if appropriate, remains the same. Because of the direct measurement of the amount of toner transferred to the substrate 3, the amount of toner transferred to the substrate 3 by the printing unit 9 is therefore adapted appropriately. In this way, a control loop can be implemented, which permits the automation of the printing process.

Figure 2:
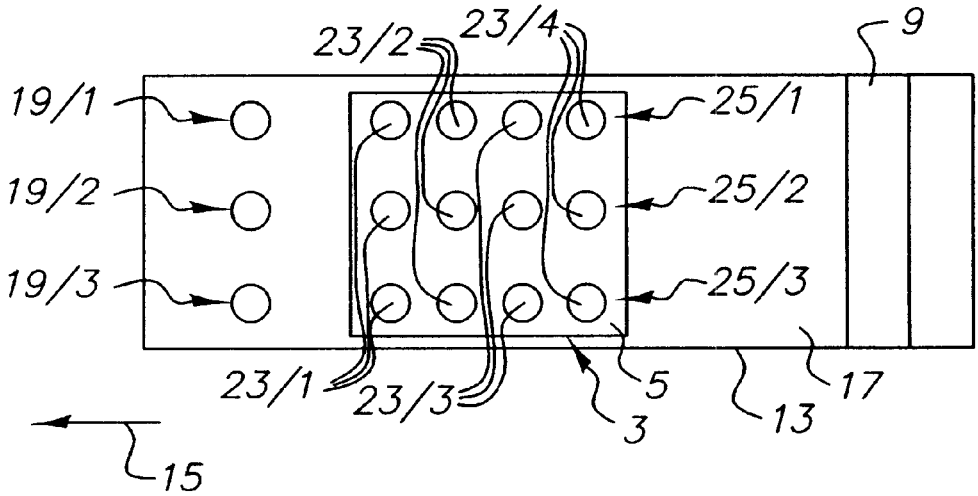
FIG. 2 shows a plan view of the transport surface of a transport belt for conveying a substrate with test images applied to the substrate.

Of course, the measuring device 21 can also have a plurality of first sensors 19/1 to 19/3, which are arranged over the width of the printing machine 1, that is to say transversely over the width of the transport belt 13, distributed at a distance from one another (FIG. 2). In a further exemplary embodiment of the printing machine 1 (not illustrated), provision is made for at least a first capacitive sensor 19/1 to 19/3 to be arranged in each case downstream in the machine running direction 15 of each of the printing units of the printing machine 1. In order to reduce measurement errors which are caused by electrical charges and toner particles/residues on the transport surface 17 of the transport belt 13, an advantageous exemplary embodiment provides for the at least one first capacitive sensor 19/1 to 19/3 to be arranged, in the machine running direction 15, downstream of a treatment device (web-conditioning charger), not shown in FIG. 1, for the transport belt 13. With the aid of the treatment device, electrical charges and, if appropriate, dirt particles and toner residues are removed from the transport surface 17 before the measurement.

The measurement accuracy of the measuring device 21 or of the capacitive sensor 19/1 to 19/3 can, for example, be influenced by a different thickness of the transport belt 13, since fluctuations in the thickness of the transport belt 13 and its composition change the effective relative dielectric constant $\epsilon$. In order to be able to take account of any thickness fluctuation in the transport belt 13 which may be present, the distance between the first sensor 19/1 to 19/3 arranged in a fixed position and the measured object can be measured at the time when only the transport belt 13 without a substrate 3 placed on it is located under the sensor 19/1 to 19/3. The measured values can be used for the purpose of correction.

The moisture of the paper sheet 5 exerts a further influence on the measurement accuracy of the measuring device 21. A comparative measurement between unprinted paper sheets and paper sheets with applied toner helps to reduce measurement errors here. A further possibility is to print at least one test image 23/1, 23/2, 23/3, 23/4 directly onto the transport surface 17 of the transport belt 13, as shown in FIG. 3.

FIG. 2 shows a plan view of the transport surface 17 of the transport belt 13. Parts which have already been explained using FIG. 1 are provided with the same designations, so that to this extent reference is made to the description relating to FIG. 1. In this case, the test images 23/1, 23/2, 23/3, 23/4 are applied to the substrate 3, which lies on the transport belt 13, in each case three test images 23/1, 23/2, 23/3 and 23/4 being printed on for the colors black, yellow, magenta and cyan. The test images 23/1, 23/2, 23/3, 23/4 printed in one color in each case are distributed at a distance from one another over the width of the substrate 3, that is to say in each case a test image 23/1, 23/2, 23/3, 23/4 of a different color is located in a row—as seen in the machine running direction 15. Each of the rows of test images 25/1 to 25/3 is respectively assigned a first, capacitive sensor 19/1, 19/2 and 19/3 which, as indicated in FIG. 2, has at least one electrode with a cross section which is circular here. It becomes clear that the shape and size of the test images 23/1, 23/2, 23/3, 23/4 which are illustrated in FIG. 2 and arranged in a rectangular matrix is the same as the size and shape of the first, capacitive sensors 19/1 to 19/3. The size and/or shape of the test images 23/1, 23/2, 23/3, 23/4 and of the electrodes of the first, capacitive sensors 19/1 to 19/3 can be varied virtually as desired.

Since the toners for the various colors can have different relative dielectric constants $\epsilon$, in an advantageous embodiment, a measurement of the amount of toner is carried out for each color and each mixed color, so that a characteristic curve of the amount of toner per unit area of the test image or the print 7 in relation to the sensor output signal from the sensors 19/1 to 19/3 can be determined.

The measuring sensitivity of the measuring device 21 can further be influenced by fluctuations in the distance between the transport belt 13 and the at least one capacitive sensor 19/1 to 19/3. In order to reduce the fluctuations in the distance, the transport belt 13 in the exemplary embodiment shown in FIG. 1 is guided on a special guide rail 27 underneath the sensor 19/1 to 19/3, which ensures flat contact with the transport belt 13. In this case, the guide rail 27 is flat and arranged horizontally. In another exemplary embodiment (not illustrated), it can also be curved.

A further reduction in the measurement error arising from distance fluctuations between the capacitive sensor 19/1 to 19/3 arranged in a fixed position and the transport belt 13 is achieved by the distance between the sensor 19/1 to 19/3 and the guide rail 27 being measured. This can be carried out, for example, by a second sensor (not illustrated), which can be formed by an inductive distance sensor in the case of a guide rail consisting of metal. Distance fluctuations, which can be caused by machine vibrations, for example, can be registered in this way and can be taken into account in measuring the amount of toner transferred to the substrate.

In an advantageous exemplary embodiment, the first sensors 19/1 to 19/3 and the at least one second sensor are combined to form a sensor system which, for example, can form one structural unit.

It remains to be recorded that a capacitive sensor 19/1 to 19/3 or a plurality of capacitive sensors 19/1 to 19/3 can be arranged downstream of each of the printing units in the printing machine 1. In one exemplary embodiment, provision is made for a sensor 19/1 to 19/3 or a plurality of capacitive sensors 19/1 to 19/3 to be arranged only downstream of the last printing unit in the printing machine 1.

FIG. 3 shows a similar arrangement to that in FIG. 2, with the significant differences that the test image 23/1, 23/2, 23/3, 23/4 consists of only one row of test images 25/4, and the test image 23/1, 23/2, 23/3, 23/4 is applied directly to the transport surface 17. The measurement method corresponds to that described above, the capacitive sensor 19/1 to 19/3 registers the test images 23/1, 23/2, 23/3,23/4, which each contain toner of one color, one after another. The changing capacitance of the capacitive sensor 19/1 to 19/3 in the embodiment according to FIG. 3 is based in a similar way on the change in the distances between the capacitive sensor 19/1 to 19/3 and the transport surface 17, on the one hand, and the respective test image 23/1, 23/2, 23/3, 23/4, on the other hand.

The higher the toner is applied to the transport surface 17, that is to say the greater the amount of toner and the greater the amount by which the distance to the capacitive sensor 19/1 to 19/3 changes, the higher is the change in the capacitance. Using this embodiment, as compared with the others, a reliable measurement method is disclosed, the influences of the substrate 3 no longer interfere in the measurement and the measured results.

The method according to the invention readily emerges from the preceding explanations relating to FIGS. 1, 2 and 3.

The invention has been described in detail with particular reference to certain preferred embodiments thereof, but it will be understood that variations and modifications can be effected within the spirit and scope of the invention.

Parts List

1 Printing machine
3 Substrate

5 Paper sheet
7 Print
9 Printing unit
11 Transport device
13 Transport belt
15 Machine running direction
17 Transport surface
19 First sensor
21 Measuring device
22 Surface
23 Test image
25 Row of test images
27 Guide rail

What is claimed:

1. A method of applying a toner print by a printing process to a substrate (3), preferably paper or board, or to a transport surface (17) for a substrate (3), which comprises the following steps: applying the toner to the substrate such that the toner print contains at least one test image (23/1, 23/2, 23/3, 23/4), and the shape and/or size of the test image is matched to at least one electrode of a sensor (19; 19/1, 19/2, 19/3) used to measure the amount of toner, measuring the amount of toner transferred to the substrate by a measuring device (21), and influencing the printing process in such a way that the difference between the actual amount of toner in the toner print on the substrate and a desired amount of toner in the toner print applied to the substrate is reduced or remains constant.

2. The method as claimed in claim 1, wherein the toner print contains at least one test image (23/1, 23/2, 23/3, 23/4), which is preferably applied to a transport surface (17) of a transport device (11) for the substrate (3).

3. The method as claimed in claim 1, wherein, for each color and, if appropriate, for each mixed color, at least one test image (23/1, 23/2, 23/3) is printed, the amount of toner applied is measured and, from this, a characteristic curve "amount of toner per unit area in relation to sensor output signal" from the sensor (19; 19/1, 19/2, 19/3) is determined.

4. The method as claimed in claim 1, wherein a sensor (19; 19/1, 19/2, 19/3) is triggered in such a way that it measures the amount of toner at the time at which the print, preferably moving past it, is located opposite it.

5. The method as claimed in claim 4, wherein the sensor (19; 19/1, 19/2, 19/3) is a distance sensor, and wherein, the measurement of the amount of toner, a comparative measurement between an unprinted area and an area with applied toner is carried out.

6. A printing machine for applying a toner print by a printing process to a substrate (3), preferably paper or board, or to a transport surface (17), including at least one transport belt (13), for a substrate (3), comprising: a measuring device (21) for determining the amount of toner applied to the substrate by a printing unit (9), said measuring device (21) having at least a first capacitive sensor (19; 19/1, 19/2,19/3), in particular a proximity switch or distance measuring device arranged opposite at least one said transport belt (13) of a transport device (11) for the substrate (3), at least one of said first capacitive sensor is arranged downstream of said printing unit (9), as viewed in the transport direction of the substrate, in at least the area of said at least first capacitive sensor (19; 19/1, 19/2,19/3), said at least one said transport belt is guided over at least one guide rail (27) in particular in a fixed position, wherein at least two capacitor plates are formed by said at least first capacitive sensor (19; 19/1, 19/2, 19/3) and the substrate or transport surface.

7. The printing machine as claimed in 6, wherein a plurality of first sensors (19; 19/1, 19/2, 19/3) are arranged over the width of said transport belt, preferably at a distance from one another.

8. The printing machine as claimed in claim 6, wherein the measuring device (21) comprises at least a second sensor which is arranged in a fixed position and which is used to determine the distance between itself and the guide rail (27).

9. The printing machine as claimed in claim 8, wherein the second sensor is an inductive distance sensor.

10. The printing machine as claimed in claim 9, wherein the first and second sensors are combined to form a sensor system.

* * * * *